US005545441A

United States Patent [19]

Land

[11] Patent Number: 5,545,441

[45] Date of Patent: Aug. 13, 1996

[54] METHOD OF MAKING A TEXTURED GLASS YARN FABRIC FOR USE IN WALLCOVERINGS ACOUSTICAL PANELS AND CEILING TILES

[76] Inventor: Frank J. Land, 725 Miller Ave., Suite 241, Freeport, N.Y. 11520

[21] Appl. No.: 502,540

[22] Filed: Jul. 14, 1995

Related U.S. Application Data

[62] Division of Ser. No. 92,812, Jul. 16, 1993, Pat. No. 5,433, 997.

[51] Int. Cl.[6] ..... B05D 3/02

[52] U.S. Cl. ..... 427/389.8; 427/393.4

[58] Field of Search ..... 427/389.8, 393.4

[56] References Cited

U.S. PATENT DOCUMENTS

| | | | |
|---|---|---|---|
| 2,662,044 | 12/1953 | Morrison | 154/52 |
| 2,955,053 | 10/1960 | Roth | 117/37 |
| 3,448,823 | 6/1969 | Smith | 181/33 |
| 3,589,934 | 6/1971 | Schimmel | 117/76 |
| 3,591,408 | 7/1971 | Marzocchi | 117/54 |
| 3,764,448 | 10/1973 | Nisbet et al. | 161/67 |
| 3,919,444 | 11/1975 | Shayman | 428/95 |
| 3,950,868 | 4/1976 | Holroyd et al. | 38/66 |
| 4,010,301 | 3/1977 | Anderson et al. | 428/95 |
| 4,010,302 | 3/1977 | Anderson et al. | 428/95 |
| 4,078,110 | 3/1978 | Fletcher et al. | 428/93 |
| 5,177,948 | 1/1993 | Kolmes et al. | 57/229 |
| 5,185,197 | 2/1993 | Nixon | 428/246 |

FOREIGN PATENT DOCUMENTS

| | | |
|---|---|---|
| 154939 | 7/1986 | Germany . |
| 3055353 | 3/1991 | Japan . |

OTHER PUBLICATIONS

J. Anne McConney, "Toxicity: Sanity Surfaces but the Hard Work Lies Ahead", *Industry* Dec. 1989, pp. 61–62.

Edward G. Casazza, "Wall Covering Toxicity Level Could Prove Fatal", *TODAY'S NURSING HOME,* Oct. 1989.

"Standard Classification of Wallcovering by Durability Characteristics", Designation: F–793–90, *American Society for Testing and Materials,* reprinted from the Annual Book of ASTM Standards, pp. 1–5.

"Standard Specification for Wallcovering", Designation: F–1141–80, *American Society for Testing and Materials,* reprinted from the Annual Book of ASTM Standards, pp. 1–2.

Ann Hagedorn, "Turning Safety Into a Competitive Issue", *The Wall Street Journal* Jul. 25, 1989.

*Primary Examiner*—Christopher W. Raimund

*Attorney, Agent, or Firm*—Burns, Doane, Swecker & Mathis, L.L.P.

[57] ABSTRACT

A method of making a fabric for use in wallcoverings, wall paneling, and ceiling tiles is disclosed. The wallcovering comprises a woven fabric layer of pigmented resin textured glass, a stain repellant polymeric fluorocarbon face coating applied to a first side of the fabric layer, and an opaque back coating comprising an acrylic resin applied to a second side of said fabric layer. The fabric is flame retardant, flexible and has substantial dimensional stability and strength.

7 Claims, 2 Drawing Sheets

METHOD OF MAKING A TEXTURED GLASS YARN FABRIC FOR USE IN WALLCOVERINGS ACOUSTICAL PANELS AND CEILING TILES

This application is a divisional, of application Ser. No. 08/092,812, filed Jul. 16, 1993 now U.S. Pat. No. 5,433,997.

BACKGROUND

The present invention is directed to a textured glass yarn fabric for use as wallcoverings, acoustical paneling and acoustical ceiling tiles and a method of making the same.

Glass yarns have long been used to make carpets and other pile fabrics. For example, U.S. Pat. No. 3,764,448, incorporated by reference herein, discloses a glass pile fabric for use as carpeting and upholstery. Glass yarns have also been used as draperies. U.S. Pat. No. 4,078,110 discloses a flexible pile thermal barrier insulator comprised of yarns, warp yarns, pile yarns and stuffers made of silicon dioxide.

However, wallcoverings, i.e., wall paper, have typically been made from paper or vinyl. Other wallcoverings include paint and fabric wallcoverings. However, such wallcoverings are not easily cleanable, and in some cases, may be toxic. Recent regulations require toxicity and flammability testing on home furnishings. These prior products do not satisfy the toxicity and/or flammability standards set forth in the industry. Another type of available wallcovering is made from a 100% polyolefin material. However, this material has shown to involve installation problems. Moreover, fabric, vinyl and polyolefin wallcoverings are very expensive.

There are three areas where synthetic products used to make textile wallcoverings, panel fabrics, and ceiling tiles, are an especially high public health risk due to their chemical formulas. First, is smoke inhalation and combustion toxicity caused by noxious gases given off by synthetics when they burn. Second, is sick building syndrome in which volatile organic chemical off gassing creates indoor air pollution. Third, is such synthetics are not inherently flame resistant and chemicals must be added to make the synthetic products inherently flame resistant so as to resist ignition when a flame is held under it. When the chemical content of a synthetic material is increased, a toxic, noxious product may be created when it is exposed to flame. Further, the increased chemical content creates indoor air pollution by these same chemicals when they volatilize.

One problem well known in the art of glass fabrics is the difficulty of coloring yarns or the products resulting therefrom which are substantially comprised of glass fibers as disclosed in U.S. Pat No. 2,955,053 at column 1, lines 52–65. It is well known that fabrics fashioned of glass cannot be dyed as cotton or rayon, for example. By reason of the chemical inertness of the base material dyeing techniques are ineffective on such materials. Accordingly, some have prime coated glass textile fiber or fabric with various adherent coatings which are capable of receiving dye substances. U.S. Pat. No. 3,589,934 discloses such a process where glass fibers or fabrics are coated with an interpolymer comprising a non-rubbery interpolymer of a polyunsaturated hydrocarbon monomer and at least one monoolefin monomer having a single copolymerizable ethylenic group. The prime coating is first cured and then the coated fabric is contacted with an organic dye. U.S. Pat. No. 3,591,408 discloses a process for coloring glass fibers and fabrics wherein the glass fibers are treated with the combination of an amino and/or epoxy silane, its silanol or polysiloxane and a fiber reactive "Procilan" dye or "Procion" dye having groupings that react with the amino or epoxy groups of the organo silicon compound to form an organo silicon compound to form an organo silicon-dye compound that becomes strongly anchored to the glass fiber surfaces with sufficient dye concentration to impart the desired color intensity.

Another problem known in the art of glass yarns is the lack of flexibility or resiliency of glass fiber products. Many have weaved in other non-glass fibers into the resultant fabric to make it more flexible. U.S. Pat. No. 2,662,044 discloses treating a mass of glass fibers in one or more combinations of steps including impregnating and bonding, to provide a product having the integrated properties of glass fibers and resinous, resin-like, or rubber-like materials.

In the late 1980's, a product marketed under the name Swedwall Chromafabric was available. The product, although initially referred to as a "fiberglass wallcovering", was a fabric used to make vertical blinds for windows. Swedwall Chromafabric had no backing and no facing, but used an additive added to the glass fiber yarns to provide stiffness. It is not stain repellant and it is not dimensionally stable so that the pick lines move over time. The composition of the product is believed to be approximately 75% fiberglass, approximately 20% flame retardant polymer coatings and approximately 5% organic and inorganic pigments. This product did not lay flat on the wall and was so stiff that it could not be bent around corners. It was so porous that the adhesive seeped through and stained the fabric. It also absorbed significant amounts of dirt and dust in relatively short periods of time.

East German patent publication No. 154,939 (WPI Acc. No. 82-046725/49, XRAM Acc. No. C82-J04672) discloses a glass fiber sheet which can be used for front walls and outdoor surfaces and has glass fibers comprising the parameters: wt/area 150/400 g/sq.m., warp thread count 55–90 (78) threads/dm, weft thread count 20–28 (26) threads/dm, warp thread fineness 20–68 tex and weft thread fineness 450 tex. One surface is coated with a composition containing, by weight, 10–30 (15)% plasticizer-containing polyvinyl acetate, 2.5–10 (5)% polyacrylate and 60–87.5 (80)% white pigment, e.g. chalk, CaCO3 and/or lithopone. The non-coated surface is printed with a paste mixture containing 90–99% crosslinked polyacrylate and 1–10% pigment dyestuff. This material presents problems in that the plasticizer increases significantly the flammability of the end product.

SUMMARY

It is accordingly, an object of the present invention to provide a glass yarn fabric for wallcoverings, acoustical panels, and acoustical ceiling tiles which is non-toxic, environmentally safe, flame retardant, and affordable. It is also an object of the present invention to provide an environmentally prudent way of making the same.

It is still another object of the present invention to provide a glass yarn fabric for wallcoverings, acoustical panels, and acoustical ceiling tiles which can be made of a wide variety or spectrum of colors wherein the yarn has been dyed by direct application absorptive dyeing and not by an adherent prime coating or surface only dye treatment.

It is yet another object of the present invention to provide a glass yarn fabric for wallcoverings, acoustical panels, and acoustical ceiling tiles which is flexible, durable and easily cleaned.

According to a preferred embodiment of the present invention, a fabric is provided for use in wallcoverings, wall paneling, and ceiling tiles comprising a fabric layer comprising pigmented resin textured glass woven yarn, a stain resistant polymeric fluorocarbon face coating applied to a first side of the fabric layer, and an opaque back coating comprising an acrylic resin applied to a second side of the fabric layer, wherein the fabric is flame retardant, flexible and has substantial dimensional stability and strength.

According to the present invention, a method of making a glass yarn fabric for wallcoverings, acoustical wall panels and acoustical ceiling tiles is provided comprising the steps of weaving a pigment dyed glass fiber yarn to form a glass yarn layer, applying a stain resistant polymeric fluorocarbon face coating to a first surface of the glass yarn layer, and applying an opaque back coating layer layer comprising an acrylic resin, to a second surface of the glass yarn layer.

Still other objects, features and attendant advantages of the present invention will become apparent to those skilled in the art from a reading of the following detailed description of the embodiments constructed in accordance therewith, taken in conjunction with the accompanying drawings.

BRIEF DESCRIPTION OF THE DRAWINGS

The invention of the present application will now be described in more detail with reference to the preferred embodiments of the device, given only by way of example, and with reference to the accompanying drawings, in which.

DETAILED DESCRIPTION

Figure 1:
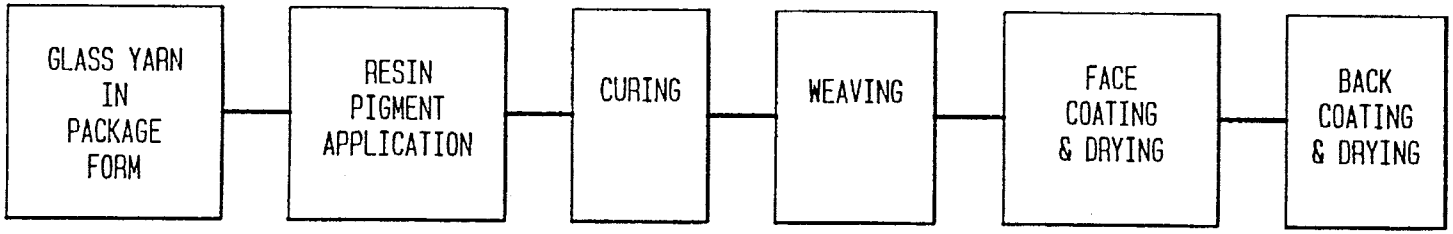
FIG. 1 illustrates a method of making a fabric for use as a wallcovering, acoustical wall panels, and acoustical ceiling tiles according to one embodiment of the present invention.
Figure 2:
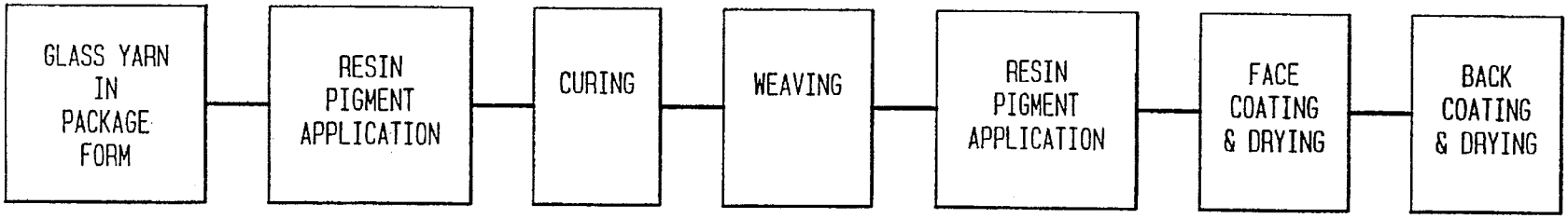
FIG. 2 illustrates a method of making a fabric for use as a wallcovering, acoustical wall panels, and acoustical ceiling tiles according to another embodiment of the present invention.
Figure 3:
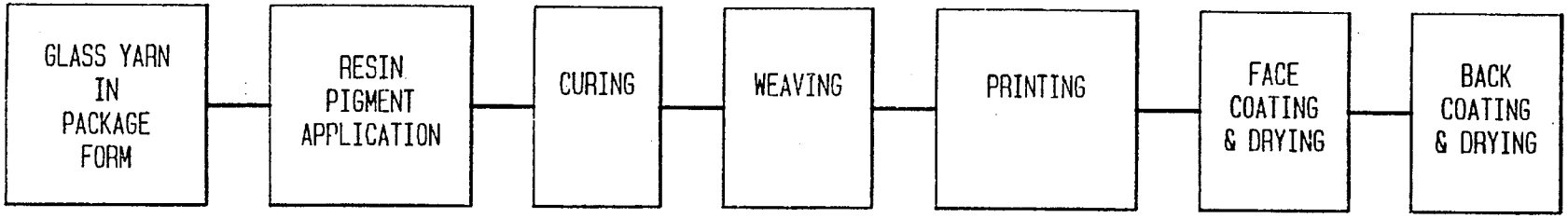
FIG. 3 illustrates a method of making a fabric for use as a wallcovering, acoustical wall panels, and acoustical ceiling tiles according to yet another embodiment of the present invention.

FIGS. 1–3 illustrate three processes for producing the glass yarn fabric with three different dyeing applications for producing different decorative dyed fabric wallcoverings according to the present invention. In making the glass woven fabric for wallcoverings, acoustical panels, and acoustical ceiling tiles according to the method illustrated in FIGS. 1, 2 and 3, packages of a very fine filament glass yarn are initially placed on a suitable creel.

The glass yarns are available for purchase from Owens Corning Fiberglas and PPG Industries, Inc. According to a preferred embodiment, the individual filaments should have an average diameter of approximately 0.00025 inch to ensure increased flexibility and strength. As examples of extremely fine glass filaments possessing the desired properties, it is noted that yarns consisting of continuous glass filaments having an average diameter of approximately 0.00015 inch are commercially available and are known as B (or Beta) filament yarns. Filaments having an average diameter of approximately 0.00018 inch are known as C filaments, and filaments having a diameter of approximately 0.00021 inch are known as D filaments. Commercial DE filaments have an average diameter of approximately 0.00025 inch. According to a preferred embodiment, 100% textured glass yarns are used in three-yarn gauges: DE 37 1/0 single end (approximtely 1560 continuous filaments), DE 75 1/0 single end (approximately 800 continuous filaments), and DE 150 1/0 single end (approximately 400 continuous filaments), and the leno selvage is made using DE 900 1/0 (left/white) (right/red).

Typically, the glass yarn filaments will have been initially coated with a size material by the producer which is designed to lubricate and protect the filaments during the subsequent manufacturing process. Usually, this size is starch-oil based and similar to the conventional sizes used in other textile operations, but other sizes such as polyvinyl alcohol are often employed. In addition, the glass yarns are preferably bulked or texturized by, for example, the "Taslan" or other conventional air jet process, with the bulking serving to facilitate resin penetration in the finishing operation, and also to provide improved yarn coverage in the completed fabric. Further, bulking adds other desirable physical properties such as improved hand and loft, and also serves to somewhat deluster the yarns.

From the creel, approximately 394 yarn ends are brought together from the packages to form a web which is passed continuously through a pigmented resin bath. This is hereinafter referred to as direct application absorptive dyeing and is capable of effectively imparting the desired color to the yarn without the use of prime coating such as a polymer coating which is capable of receiving a dye. A conventional slasher size box may be used in carrying out this process and the web may be passed through a set of squeeze rolls after immersion in the resin bath to insure a thorough penetration of the pigmented resin into the yarn ends. From the size box, the web is dried and the resin cured for example by the slasher drying cylinders. Alternatively, the web may be passed through a radiant or infrared drying oven of conventional design. Typically, the resin will be fully cured upon leaving the drying cylinders or oven, but in some instances as further described below, the resin will be only partially cured.

The formulation of the finish employed in the above process is generally conventional, and comprises for example an acrylic resin and an organic pigment. The composition may further include a stabilizer, an anti-migrant and a softener. As a specific example, the formulation shown in Table I has been found to be a satisfactory formulation for a blue finish:

TABLE I

| | Percent by weight of aqueous bath |
|---|---|
| "CD 6004" emulsified acrylic resin (Valchem, Division, United Merchants and Manufacturers) | 7.5 |
| "A 187" Silange coupling agent (gamma-glycidoxypropyl trimethoxysilane - Union Carbide) | .5 |
| "Kelgin" anti-migrant (sodium alginate - Kelco Co.) | 1.2 |
| "Ahcovel 100" softener (modified fatty amide - I.C.I. Inc.) | .4 |

TABLE I-continued

| | Percent by weight of aqueous bath |
|---|---|
| "Triton X-155" stabilizer (alkylaryl polyether alcohol - Rohm & Haas) | .2 |
| "Monastral Blue B" organic pigment (E. I. du Pont) | 8.0 |

Typically, the resin solids add-on to the yarn will be about 6% of the weight of the yarn.

As an alternative to the above-described resin bonded pigment finish, the finish could be adhered to the surface of the pile yarns by the monomer grafting process as known in the art.

The resin pigment dyed yarn is then cured by a finishing process to impart the "absorptive" aspect of the direct application absorptive dyeing process. The yarn, including the inorganic pigments added thereto, is heated to a high temperature. In this manner, the inorganic pigments are absorbed into the glass fibers so as to create a uniform pigment throughout the fibers. Resin bonded pigment finished yarns, that is, pigment dyed yarn, may be purchased from Carolina Narrow Fabric Co., Winston-Salem, N.C. Such yarns have the characteristics of being flexible, flame resistant, strong, dimensionally stable, and able to absorb pigmentation or dye in a uniform manner throughout the yarn.

Figure 5:
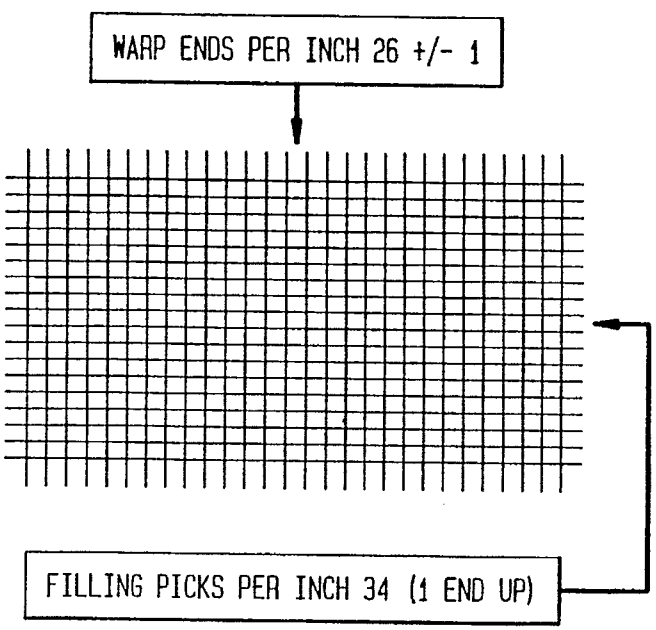
FIG. 5 illustrates a weave pattern for weaving the glass fiber yarn according to another embodiment of the present invention.
Figure 4:
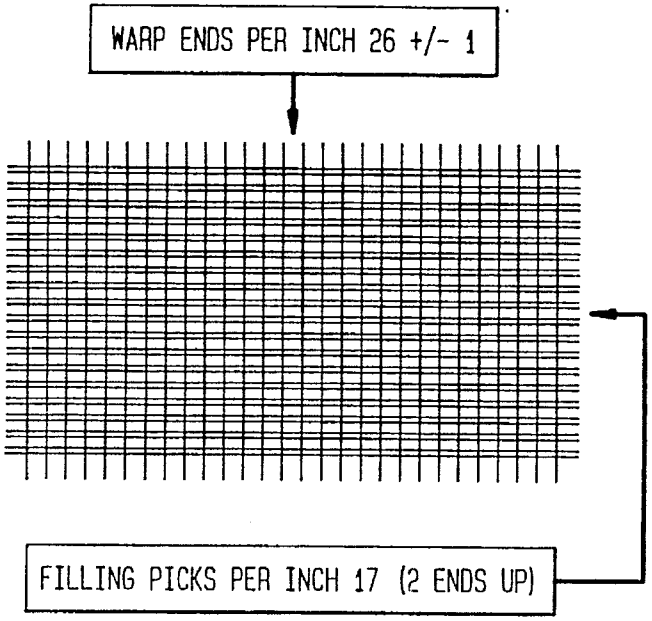
FIG. 4 illustrates a weave pattern for weaving the glass fiber yarn according to one embodiment of the present invention.

The finished, dyed yarn is then tight woven into various styles, including but not limited to dobby, jacquard, loose set, close set, malimo, raschel, leno, warp knit, weft knit, and tricot. Two possible weave styles are shown in FIGS. 4 and 5. The weaving is done using known looms. However, for best results, preferably Sommet 190 CM Thema 11-E or Dornier 180–210 CM GTV 650 heavy duty looms built after 1985 are used. A Tecnomatex® accumulator which can handle up to four colors for filling, one or two strands per insertion. Preferably, two strands would be used. A separate bar should be used to prevent rolling of the filling strands. As shown in FIG. 4, the weave can be warp ends per inch 26±1 and filling picks per inch 17 (two ends up) and warp ends up per inch 26±1 and filling picks per inch 17 (one end up). The type of weave may be plain or some other type, depending on the design desired. One pick leno, feather edge selvage should be used. For the reed description, 26 dents per inch, or a total of 1582 dents for a 60 inch width should be used. The preferred loom speed is about 150 picks per minute, maximum.

According to a preferred embodiment, the width of the fabric should be 60 inches, with total individual yarn ends, excluding leno selvage, at 1576. The reed speed should be 56.615 and four harnesses should be used. The following additional specifications for the loom should be used according to a preferred embodiment: heddles/harness: 394 excludes leno; ends/heddle: one; ends/dent: (reed) one; and drop wire: 0.008 polished stainless-heavy setting. Vacuums on the loom should be located at accumulators and filling insertion line. The standard woven cut length on the loom should be 250 linear yards. The vacuum should be set at high and a hand vacuum may be necessary if a grading vacuum does not clear all fly/lint. The finished woven fabric should be free of dirt and lint, suitable for applying facings and backings.

In the process shown in FIG. 1, the resin pigment application step is performed to dye the individual yarns with a myriad of different colors. In FIG. 2, the first resin pigment application step produces a yarn which is dyed white. The second resin pigment application step consists of piece-dyeing the woven fabric into different solid colors. The white pigment applied in the first resin pigment application step facilitates the dyeing of the pieces in the second pigment application step. In FIG. 3, the next step involves printing which consists of a heat transfer application of a solid dye pattern onto the fabric. According to known heat transfer methods, when the solid dye is heated, it turns into a gas which dyes the fabric in the pattern of the solid dye.

In FIG. 1 after the weaving step, in FIG. 2 after the second resin pigment application step and in FIG. 3 after the printing step, a face coating and drying step is performed. According to a preferred embodiment, this step uses any standard finishing range suitable for fluorochemical emulsions which confers oil and water repellency. According to a preferred embodiment, the fluorochemical emulsion is FC-247 Scotchgard™ made by 3M Protective Chemical Products Division, or Teflon® or Zonyl® 8070, made by du Pont/Ciba-Geigy Textiles Finishing Group. In particular, the face coating is a polymeric fluorocarbon selected from tetrafluoroethylene, fluorinated ethylene propylene, hexafluoropropylene, or a fluorosurfactant wetting agent. FC-247 is a fluorochemical emulsion which confers oil and water repellency and produces a stain resistant finish which also has superior abrasion and dry soil resistance without negatively affecting hand or luster. Table II shows the material description and typical properties of FC-247:

TABLE II

| Material Description | Typical Properties |
|---|---|
| Appearance | Off-white emulsion |
| Typical Analysis | 30% Solids<br>59% Water<br>8% Ethylene Glycol<br><3% Emulsifier<br><1% Ethyl Acetate |
| Charge | Cationic |
| Density | 9.4 lbs/gal (1.1 kg/l) |
| pH | 1–3 |
| Shipping & Storage | Non-Red Label: Pensky-Martens Closed Cup Flash Point greater than 200° F.<br>Steaflash CC >212° F.<br>FC-247 should not be stored at temperatures over 120° F.<br>FC-247 is freeze/thaw stable to −10° F. as long as it does not undergo vibration during thawing. If exposed to freezing temperature, return to room temperature before using. Avoid agitation during thawing process. |

The FC-247 can be applied by padding or by an aqueous spray technique. Padding can be accomplished on regular mill pad equipment, consistent with normal mill procedures. Bath temperatures of 60°–100° F. are generally suitable.

For an aqueous spray system, an airless method is preferred, where the atomization of the spray is done by fluid pressure. Uniform application of the spray across the fabric width is preferred. A wet pick-up of 30% is preferred, using 40–60 g/l.

After the face coating layer is applied, the fabric is then cured. A drying temperature of 200° F. is preferred, though temperatures up to 350° F. may be used.

After the fabric is cured, a back coating is applied and the resulting fabric is cured. According to a preferred embodiment, an acrylic resin is used as the back coating. The backing lends flexibility to the fabric. Additionally, coloring is added to the acrylic resin to provide an opaque appearance to the fabric backing. According to a preferred embodiment, two formulas of the acrylic resin backing are used to pass worldwide industry standards for product use with glass decorative fabrics. The acrylic resin (ethyl acrylate, methyl methacrylate and water) can be purchased from Rohm & Haas. The two formulas are shown in Tables III and IV below.

TABLE III

| Material Description is used worldwide excluding Germany and Japan | Typical Properties |
|---|---|
| appearance | white |
| typical analysis | 35.0% ethyl acrylate<br>4.0% methyl methacrylate<br>39.5% water<br>14.0% titanium dioxide<br>3.0% bromine<br>3.0% chlorine<br>1.0% ammonium hydroxide<br>0.5% sodium polyacrylate |
| pH | 8–9 |
| glass transition temperature | Tg −10 ± 5 |
| range temperature | 250° F. |

TABLE IV

| Material Description For Germany and Japan | Typical Properties |
|---|---|
| appearance | white |
| typical analysis | 30.0% ethyl acrylate<br>4.0% methyl methacrylate<br>39.5% water<br>14.0% titanium dioxide<br>11.0% hydrated metal oxide<br>1.0% ammonium hydroxide<br>0.5% sodium polyacrylate |
| pH | 8–9 |
| glass transition temperature | Tg −10 ± 5 |
| range temperature | 250° F. |

The above values are for exemplary purposes only. Heating the fabric with the backing at 250° F. gives excellent durability to the fabric. However, it is possible that a range temperature between about 225° F. and 275° F. can also be used in both formulations. It is understood that other compositions are possible and within the skill of the ordinary artisan in possession of the present disclosure. The ethyl acrylate can be used in either formulation in a percent by weight range of about 27.0 to 37.0%, preferably about 29–36% by weight. According to a preferred embodiment, ethyl acrylate is used in the range of about 30.0 to 35.0% by weight.

The methyl methacrylate may be used in either formulation in the range of about 3–5% by weight, preferably about 3.5–4.5%. According to a preferred embodiment, about 4% methyl methacrylate is used. Water may be used in either formulation in a range from about 37.5%–41.5% by weight, preferably about 39–40%. According to a preferred embodiment, about 39.5% water is used. Titanium dioxide may be used in either formulation in a range from about 13–18% by weight, preferably about 13.5–14.5%. According to a preferred embodiment, about 14% titanium dioxide is used. Bromine and chlorine may be used in the formulation of Table III in the range of about 2–4% by weight (each), preferably about 2.5–3.5 by weight. According to a preferred embodiment, about 3% each bromine and chlorine is used. In the formulation of Table IV, a hydrated metal oxide is used in the range of about 10–15% by weight, preferably about 10–12%. According to a preferred embodiment, about 11% hydrated metal oxide is used.

The bromine and chlorine used for providing flame retardant characteristics in the formulation of Table I, are halogens prohibited in fabrics used for wallcoverings in Germany and Japan. Accordingly, they are removed and a hydrated metal oxide is used in the formulation of Table II to provide flame retardant properties. The hydrated metal oxide can be aluminum tri-hydrate, magnesium hydroxide, or like chemicals.

The weight of the acrylic resin backing applied to the glass fiber layer may vary depending on the end product use. In particular, according to a preferred embodiment of the present invention, ceiling fabrics and panel fabrics have about 1.25 ounces backing per square yard and wallcovering fabric has about 2.25 ounces backing per square yard.

For the fabrics that are to be used as acoustic wall panels and ceiling tiles, the fabric is sold to an acoustic tile manufacturer who laminates it onto the appropriate acoustical panel or tile. These acoustical panels are usually mineral wool board or fiberglass acoustical board.

Figure 6:
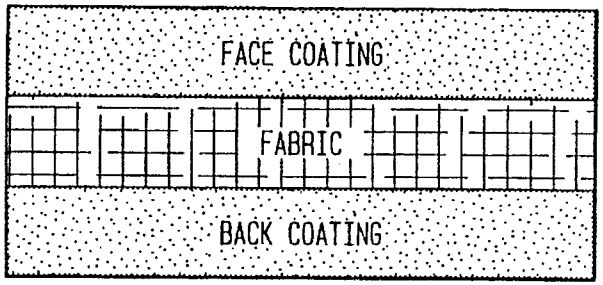
FIG. 6 illustrates the fabric for use as a wallcovering, acoustical wall panels, and acoustical ceiling tiles according to an embodiment of the present invention.

FIG. 6 illustrates the fabric for use as wallcoverings, acoustic wall panels and ceiling tiles made according to the above described processes. The fabric consists of a fabric layer comprising pigmented resin textured glass woven yarn which is created by the first four steps described with respect to FIGS. 1–3. The face coating layer consists of a stain repellant polymeric fluorocarbon coating applied to the surface of the fabric layer which faces outward when in use, according to the face coating and drying step described above. The back coating layer consists of an acrylic resin having an opaque coloring applied to the surfaced of the fabric layer facing inward when in use according to the back coating and drying steps described above. The resulting fabric is flame resistant, flexible, non-toxic, environmentally safe, and has substantial dimensional stability and strength.

Tables V and VI below show the performance specifications for the fabric made according to preferred embodiments of the present invention.

TABLE V

| COMMERCIAL WALLCOVERING | |
|---|---|
| PATTERN | 2000 |
| WEAVE | PLAIN WEAVE |
| CONSTRUCTION | ENDS 17 (2 ENDS UP)<br>PICKS 26 ± 1 |
| YARN | 1-PLY |
| CONTENTS | 100% JEWEL (TEXTURED DYED) GLASS YARN |
| WEIGHT | 14.40 ± 1.0 OZ./SQUARE YARD FINISHED |

TABLE V-continued

| | |
|---|---|
| | 23.60 ± 2.0 3/LINEAR YARD FINISHED |
| WIDTH | 60 INCHES/56–57 USABLE |
| THICKNESS | 0.03-in. ± 0.005-in. (0.86 mm) |

PERFORMANCE

| | |
|---|---|
| TENSILE (ASTM D-1682) | 124–175, preferably 138.4 LBS. (warp) I 180–218 preferably 197 LBS. (fill) |
| TEAR RESISTANCE (ASTM D-2261) | 22.6–29.2, preferably 26.8 LBS. (warp) I 26.2–28.9, preferably 27.5 LBS. (fill) |
| MOISTURE REGAIN (ASTM D-2654) | 0.5% MAX, preferably 0.26% MAX |
| HEAT AGING RESISTANCE (ASTM F 793) | PASSES |
| ELONGATION | 8.3–8.7, preferably 8.4 (warp) I 5.0–5.7, preferably 5.4 (fill) |
| STAIN RESISTANCE (ASTM F 793, §7.5) | Rated NO CHANGE for liquids tested, Classification CATEGORY III, IV, V, and VI |
| COLORFASTNESS TO LIGHT | |
| (AATCC-16A) | HOURS = 100, RATING = 5 - NO CHANGE |
| (AATCC-16E) | AFU'S = 40, RATING = 4 - SLIGHTLY CHANGED |
| COLORFASTNESS TO CROCKING (AATCC-8) | WET = 5-NO CHANGE, DRY = 5-NO CHANGE |
| ABRASION RESISTANCE (ASTM D-3597 MODIFIED VOLUNTARY PROD. TS-198) | CYCLES = 15,000, RATING = HEAVY DUTY |
| COLORFASTNESS TO HEAT AGING (AATCC EVAL. PROD. 1) | 300 DEGREES FAHRENHEIT FOR 30 MINS. 5 = NO CHANGE |
| COMBUSTION TOXICITY TESTING | ARTICLE 15, PART 1120, NYS UNIF. FIRE |
| NYS DOS #: | PREV. BUILDING CODE of the CITY OF NEW YORK (UPITT TEST SERIES) |
| NYC MEA #: | $LC_{50}$ value = 29.6 grams, $LC_{50}$ ($LA_{50}$ value = 68,173 $mm^2$ Surface |

FLAMMABILITY

| | | |
|---|---|---|
| BOARD | ¼ INCH GRC | ½ INCH GYPSUM |
| PRIMER/EVANS #: 01016, ADHESIVE | EVANS #: 00234 | EVANS[#]: 00234 |
| ASTM E-84 91a | CLASS A | CLASS A |
| FLAME SPREAD | 5 | 25 |
| SMOKE DEVELOPMENT | 0 | 20 |
| ROOM CORNER BURN TEST (UBC 42-2) | PASS | Other Information: |
| NFPA 701 (SMALL SCALE) | PASS | 1. 180 SKU's IN BOOK |
| FAR 25.853 | PASS | 2. APPLICATION INSTRUCTIONS INCLUDED WITH BOLT |
| BOSTON FIRE CODE | BFD IX-1 | |
| CALIFORNIA 117 | CLASS I | |
| CANADA, CAN/ULC-S102 (12 mm GWB) | FSCI = 12 | |
| CANADA, CAN/ULC-S102 (12 mm GWB) | SD = 7 | |
| ENGLAND, BS 476, PART 6 (12.5 mm PB) | APPROVED | |
| ENGLAND, BS 476, PART 7 (12.5 mm PB) | APPROVED | |

TABLE VI

ACOUSTICAL PANEL FABRIC

| | |
|---|---|
| PATTERN | 1000 |
| WEAVE | PLAIN WEAVE |
| CONSTRUCTION | ENDS 17 (2 ends up) PICKS 26 ± 1 |
| YARN | 1-PLY |
| CONTENTS | 100% JEWEL (TEXTURED DYED) GLASS YARN |
| WEIGHT | 13.25 ± 0.5 OZ./SQUARE YARD FINISHED 22.08 ± 1 OZ./LINEAR YARD |
| WIDTH | 60 INCHES/58 USABLE |
| THICKNESS | 0.181 ± 0.005 (inches) |

PERFORMANCE

| | |
|---|---|
| TENSILE (ASTM D-1682) | 124–175, preferably 138.4 LBS. (warp) I 180–218 preferably 197 LBS. (fill) |
| TEAR RESISTANCE (ASTM D-2261) | 22.6–29.2, preferably 26.8 LBS. (warp) I 26.2–28.9, preferably 27.5 LBS. (fill) |
| MOISTURE REGAIN (ASTM D-2654) | 0.5% MAX, preferably 0.26% MAX |

TABLE VI-continued

| ACOUSTICAL PANEL FABRIC | |
|---|---|
| HEAT AGING RESISTANCE (ASTM F 793) | PASSES |
| ELONGATION | 8.3–8.7, preferably 8.4 (warp) \| 5.0–5.7, preferably 5.4 (fill) |
| STAIN RESISTANCE (ASTM F 793, §7.5) | Rated NO CHANGE for liquids tested, Classification CATEGORY III, IV, V, and VI |
| COLORFASTNESS TO LIGHT | |
| (AATCC-16A) | HOURS = 100, RATING = 5 - NO CHANGE |
| (AATCC-16E) | AFU'S = 40, RATING = 4 - SLIGHTLY CHANGED |
| COLORFASTNESS TO CROCKING (AATCC-8) | WET = 5-NO CHANGE, DRY = 5-NO CHANGE |
| ABRASION RESISTANCE (ASTM D-3597 MODIFIED VOLUNTARY PROD. TS-198) | CYCLES = 15,000, RATING = HEAVY DUTY |
| COLORFASTNESS TO HEAT AGING (AATCC EVAL. PROD. 1) | 300 DEGREES FAHRENHEIT FOR 30 MINS. 5 = NO CHANGE |
| COMBUSTION TOXICITY TESTING | ARTICLE 15, PART 1120, NYS UNIF. FIRE |
| NYS DOS #: | PREV. BUILDING CODE of the CITY OF NEW YORK (UPITT TEST SERIES) |
| NYC MEA #: | $LC_{50}$ value = 29.6 grams, $LC_{50}$ ($LA_{50}$ value = 128,000 $mm^2$ Surface |

| FLAMMABILITY | | |
|---|---|---|
| BOARD | ¼ INCH GRC | WIRE MESH |
| ADHESIVE | SAIRMIX 7 | LOOSE-LAID |
| ASTM E-84 91a | CLASS A | CLASS A |
| FLAME SPREAD | 0 | 20 |
| SMOKE DEVELOPMENT | 0 | 5 |
| (UBC 42-2) | PASS | Other Information: |
| NFPA 701 (SMALL SCALE) | PASS | 1. 180 SKU's IN BOOK |
| FAR 25.853 | PASS | 2. FINISHED PRODUCTS CEILING, WALL AND BAFFLE PINS |
| BOSTON FIRE CODE | BFD IX-1 | |
| CALIFORNIA 117 | CLASS I | |
| CANADA, CAN/ULC-S102 | FSC1 = 0 | |
| CANADA, CAN/ULC-S102 | SD = <5 | |
| ENGLAND, BS 476, PART 6 | APPROVED | |
| ENGLAND, BS 476, PART 7 | APPROVED | |

EXAMPLE 1

A fabric for use as a wallcovering was prepared as follows: A glass fiber DE 37 1/0 single end yarn resin pigment dyed 560 gray/blue, single ply, was tight woven in a dobby weave using a Dornier 180-210 CM GTV 650 heavy duty loom. Leno selvage was made using DE 900 1/0 (left/white) (right/red). The following weave specification was used:

Accumulator: (filling) Tecnomatex™ four color position, two strands per insertion. Separate bar to prevent filling strands rolling.

Construction: 26 warp×17 (2 ends up) filing.

Type weave: plain.

Selvage: 1 pick leno, feather edge.

Reed Description: total dents 1582 (for 60 inch width). Dents/inch 26. Oval dent super polish. Dornier specifications.

Fabric Width: (60 inches) 60–0+0.25.

Total ends excluding leno selvage: 1576.

Reed Speed: (56 inches) 56.615.

Number of Harness: four.

Heddles/Harness: 394 excludes leno.

Ends/Heddle: one.

Ends/Dent: (reed) one.

Drop Wire: 0.008 polished stainless - heavy setting.

Vacuums on loom: Locate at accumulators and filling insertion line.

Standard woven cut length on loom: 250 linear yards.

Standard inspection table: Vacuums set at high.

Finished woven fabric: free of dirt and lint.

Loom speed: 150 picks per minute, maximum.

The glass fiber fabric was then coated with a face coating consisting of a Teflon® fluorochemical emulsion made by Du Pont/Ciba Geigy. A wet pickup of 30%, using 40–60 gallons per liter was used. The formulation of the Teflon® is believed to be the same as the formulation shown in Table 1 for FC-247. The fabric having the face coating layer was then cured at a drying temperature of 200° F. A back coating was then applied using an acrylic resin backing having the composition listed in Table III. The glass transition temperature was Tg–10±5. The weight of the acrylic resin backing applied to the glass fabric layer was 2.25 ounces backing per square yard. The unit weight of the fabric was 13.1 $oz/yd_2$(442g/$m^2$). The thickness of the fabric was 0.03 in.±0.005 inc. (0.86 mm).

EXAMPLE 2

A glass yarn fabric for acoustical wall paneling and ceiling tiles was made using a DE 37 1/0 single end textured glass yarn, pigment resin dyed 560 gray/blue, single ply.

Leno selvage was made using DE 900 1/0 (left/white) (right/red). The resin pigment dyed yarn was tight woven in a dobby weave using a Dornier 180-210 CM GTV 650 heavy duty loom. The weave specification was the same as described above with respect to Example 1. A face coating of Teflon® fluorochemical emulsion. A wet pickup of 30% using 40 to 60 gallons per liter was used. The face coating fabric was cured at a temperature of 200° F. A back coating was then applied using an acrylic resin having the characteristics and properties shown in Table III. The glass transition temperature used was Tg–10±5. The weight of the acrylic resin backing was 1.25 ounces backing per square yard. The weight of the fabric was 16.0±0.5 ounces per linear yard. The thickness of the fabric was 0.181±0.005 inches.

EXAMPLE 3

The following section describes the tests and results thereof that were performed on a fabric made according to Example 2.

Heat Aging Resistance

Test Method:
ASTM F 793 "Wallcovering by Durability Characteristics", Section 7.14 Heat Aging Resistance
Test Procedure:
A test specimen subjected to a temperature of 158°±4° F. for 7 days must show no evidence of change in the decorative surface.
Test Result: Passes

Abrasion Resistance

Test Method:
ASTM Test Method D 3597, "Woven Upholstery Fabrics—Plain, Tufted or Flocked", Section 7.4 Surface Abrasion
Test Equipment:
Apparatus—Wyzenbeek Abrasion Tester
Type—Oscillatory Cylinder
Load—3 pounds
Tension—4 pounds
Abradant—S/S Wire Screen
Rating Scale:
Light Duty:
No appreciable wear evident at 3,000 cycles but appreciable wear at 9,000 cycles.
Medium Duty:
No appreciable wear evident at 9,000 cycles but appreciable wear at 15,000 cycles.
Heavy Duty:
No noticeable wear after 15,000 cycles.
Note: One (1) cycle is defined as a Double Rub.
Test Results:

| Number of Cycles | Rating |
|---|---|
| 15,000 | Heavy Duty |

Tensile and Elongation

Test Method:
ASTM Test Method D 1682, "Breaking Load and Elongation of Textile Fabrics"
Test Equipment:
Manufacturer—Instron Corporation
Type—CRE
Load Range—500 pounds
Extension Rate—12 inches per minute
Test Data:

| | FABRIC DIRECTION | | | |
|---|---|---|---|---|
| | WARP | | FILL | |
| SPECIMEN | TENSILE | ELONGATION | TENSILE | ELONGATION |
| #1 | 150.0 | 8.3 | 191.5 | 5.0 |
| #2 | 175.0 | 8.7 | 201.0 | 5.3 |
| #3 | 124.5 | 8.3 | 180.0 | 5.7 |
| #4 | 132.5 | 8.3 | 217.5 | 5.3 |
| #5 | 110.0 | 8.3 | 195.0 | 5.7 |

Test Results:

| FABRIC DIRECTION | TENSILE | ELONGATION |
|---|---|---|
| Warp | 138.4 lbs force | 8.4% |
| Fill | 197.0 lbs force | 5.4% |

Stain Resistance

Test Method:
ASTM F 793, "Wallcovering by Durability Characteristics," Section 7.5 Stain Resistance
Test Data:

| REAGENT | RATINGS |
|---|---|
| Distilled Water | no change |
| Ethyl Alcohol | no change |
| Acetic Acid | no change |
| Alkali Solution | no change |
| Soap Solution | no change |
| Detergent Solution | no change |
| Pure Orange Juice | no change |
| Butter | no change |
| Catsup | no change |
| Tea | no change |

Test Results:
Classification—Category III, IV, V, and VI

Tear Resistance

Test Method:
ASTM Test Method D2261, "Tearing Strength of Woven Fabrics by the Tongue (Single Rip) Method"
Test Equipment:
Manufacturer—Instron Corporation
Type—CRE
Load Range—100 pounds
Extension Rate—12 inches per minute
Test Data:

| | FABRIC DIRECTION | |
|---|---|---|
| SPECIMEN | WARP | FILL |
| #1 | 22.6 | 26.2 |
| #2 | 27.2 | 27.6 |
| #3 | 27.8 | 28.9 |
| #4 | 27.1 | 26.7 |
| #5 | 29.2 | 28.2 |

Test Results:

| FABRIC DIRECTION | TEARING STRENGTH PEAK LOADS |
|---|---|
| Warp | 26.8 lbs force |
| Fill | 27.5 lbs force |

Cold Cracking Resistance

Test Method:

ASTM F 793, "Wallcovering by Durability Characteristics", Section 7.13 Cold Cracking Resistance Test Procedure:

A test specimen measuring 2 inches in width by 10 inches in length is bent 180° around a ½ inch diameter mandrel after conditioning at 20±F.° for 30 minutes.

Test Result: Passes

Resistance to Blocking

Test Method:

ASTM D 751, "Standard Test Methods for Coated Fabrics", Sections 67 through 71, Determination of Blocking Resistance of Fabrics Coated with Rubber or Plastics at Elevated Temperatures Test Procedure:

Three test specimens were placed between glass plates and loaded with a weight of 4 pounds. The specimens were placed in an oven maintained at 150° F. for 6 hours, cooled 5 minutes, and graded. A numeric scale where: 1=No blocking; 2=Slight blocking; and, 3=Blocking, cloth separates with difficulty.

Test Result: 2, Slight blocking.

Moisture Content

Test Method:

ASTM D 2654, "Standard Test Methods for Moisture in Textiles", Procedure 2

Test Result: 0.26% Moisture Content

NFPA 701 Small Scale

Test Method:

NFPA 701, "Flame Resistant Textiles and Films", Small Scale Test.

Acceptance Criteria: A material meets the requirements if [1] no individual specimen has a Flame Time of more than 2.0 seconds; [2] the average Char Length does not exceed 4.5 inches with no individual test specimen exceeding 5.5 inches; and, [3] no residue which drips from any individual specimen continues to flame after reaching the floor of the test chamber.

Test Data:

| SPECIMEN DIRECTION | FLAME TIMES (seconds) | CHAR LENGTHS (inches) | FLAMING DRIPPINGS (seconds) |
|---|---|---|---|
| #1 Warp | 0 | 0.75 | 0 |
| #2 Warp | 0 | 0.50 | 0 |
| #3 Warp | 0 | 0.50 | 0 |
| #4 Warp | 0 | 0.30 | 0 |
| #5 Warp | 0 | 0.50 | 0 |
| Average | 0 | 0.51 | 0 |
| #1 Fill | 0 | 0.50 | 0 |
| #2 Fill | 0 | 0.75 | 0 |
| #3 Fill | 0 | 0.75 | 0 |

-continued

| SPECIMEN DIRECTION | FLAME TIMES (seconds) | CHAR LENGTHS (inches) | FLAMING DRIPPINGS (seconds) |
|---|---|---|---|
| #4 Fill | 0 | 0.50 | 0 |
| #5 Fill | 0 | 0.60 | 0 |
| Average | 0 | 0.62 | 0 |

Test Results: The fabric tested meets the requirements of NFPA 701.

California Bulletin 117

Test Method:

Bureau of Home Furnishings Technical Bulletin 117, Section E, Part 1, Upholstery Fabrics. (REF.: U.S. Department of Commerce Standard CS 191-53, "Flammability of Clothing Textiles")

Test Data:

| SPECIMEN | TIME OF FLAME SPREAD |
|---|---|
| #1 Warp | Did Not Ignite |
| #2 Warp | Did Not Ignite |
| #3 Warp | Did Not Ignite |
| #4 Warp | Did Not Ignite |
| #5 Warp | Did Not Ignite |
| #1 Fill | Did Not Ignite |
| #2 Fill | Did Not Ignite |
| #3 Fill | Did Not Ignite |
| #4 Fill | Did Not Ignite |
| #5 Fill | Did Not Ignite |

Flammability Classification: Class I, Normal Flammability

Boston Fire Code

Test Method:

Boston Fire Department Classification Fire Test BFD IX-1

Test Data:

| SPECIMEN DIRECTION | AFTERFLAME (seconds) | CHAR LENGTHS (inches) | AFTERGLOW (seconds) |
|---|---|---|---|
| #1 Warp | 0 | 2.50 | 2.0 |
| #2 Warp | 0 | 2.50 | 3.0 |
| #3 Warp | 0 | 2.00 | 2.0 |
| Average | 0 | 2.33 | 2.3 |
| #1 Fill | 0 | 2.00 | 2.0 |
| #2 Fill | 0 | 1.80 | 2.0 |
| #3 Fill | 0 | 1.50 | 2.0 |
| Average | 0 | 1.77 | 2.0 |

Classification: BFD IX-1

FAA Vertical Flame Test

Test Method:

Title 14 CFR Part 25—Airworthiness Standards: Transport Category Airplanes, Paragraph 25.853, Compartment Interiors, Appendix F, Part I(a) (1) (ii), Textiles Test Data:

| SPECIMEN DIRECTION | FLAME TIMES (seconds) | CHAR LENGTHS (inches) | FLAMING DRIPPINGS (seconds) |
|---|---|---|---|
| #1 Warp | 0 | 0.50 | 0 |
| #2 Warp | 0 | 0.40 | 0 |
| #3 Warp | 0 | 0.30 | 0 |
| Average | 0 | 0.40 | 0 |
| #1 Fill | 0 | 0.40 | 0 |
| #2 Fill | 0 | 0.50 | 0 |
| #3 Fill | 0 | 0.40 | 0 |
| Average | 0 | 0.43 | 0 |

Requirements: The average burn length may not exceed 8 inches, the average flame time may not exceed 15 seconds, and flaming drippings may not continue to burn for more than 5 seconds average after falling to the floor of the test cabinet.

Colorfastness to Light

Test Method:

AATCC Test Method 16, "Colorfastness to Light", Option A, Carbon-Arc Lamp, Continuous Light Rating:

Colorfastness ratings are based on AATCC Evaluation Procedure 1, Gray Scale for Color Change, a numeric rating system measured at 40 hours where 5=no change, 4=slight change, 3=noticeable change, 2=considerable change, and 1=much change in color.

Test Result:

| Exposure Time | Rating |
|---|---|
| 100 hours | 5 |
| 138 hours | 3 |

Colorfastness to Crocking

Test Method:

AATCC Test Method 8, "Colorfastness to Crocking: AATCC Crockmeter Method"

Rating:

Colorfastness ratings are based on AATCC Evaluation Procedure 3, Chromatic Transference Scale, a numeric rating system where 5=no change, 4=slight change, 3=noticeable change, 2=considerable change, and 1=much change in color.

Test Result:

| Exposure | Rating |
|---|---|
| Wet | 5 |
| Dry | 5 |

EXAMPLE 4

It is believed that the same or substantially similar results would be achieved if fabric made according to Example 1 were subjected to the tests described in Example 3.

EXAMPLE 5

A fabric made according to Example 1 was tested in accordance with the test methodology outlined in "Article 15, Part 1120, Combustion Toxicity Testing, New York State Uniform Fire Prevention and Building Code" Dec. 16, 1986. This testing was intended to evaluate the performance of the test article in relation to wood as required by Section 27-348(e) of the Building Code of the City of New York. The test procedure is a modification of the combustion toxicity protocol developed at the University of Pittsburgh.

The major function of the University of Pittsburgh (UPitt) laboratory test method is to provide a means of evaluating the lethal toxic potency of thermal decomposition products of test materials.

The protocol provides for the conduct of experiments under continuously changing temperature conditions (20° C./minute), and the test system generates decomposition products which continuously changes in chemical composition as the temperature increases. Animals are exposed to the decomposition products starting when the test specimen loses 1% of its initial weight.

The UPitt protocol utilizes rodent (mouse) lethality as the primary toxicological endpoint in evaluating the toxicity of the combustion atmosphere produced by a material. Separate groups of animals are exposed to the combustion atmospheres generated from different initial quantities of the test material in order to establish a concentration-response relationship. From this relationship, the concentration (defined by the protocol as the weight of sample loaded into the test furnace) estimated to produce lethality in 50% of the animals within the specified time is obtained by interpolation. This concentration, commonly termed the $LC_{50}$, is a measure of the toxic potency of the combustion atmosphere.

In accordance with NYS UFPBC Article 15, animal lethality data are supplemented with observations of the eye condition of the test animals, expressed as "all apparently normal", "some apparent damage" or "some severe damage".

Upon receipt, the material was identified, weighed, recorded and then conditioned at a temperature of 23°±3° C. and a relative humidity of 50±5% for a period of at least 24 hours.

The thermal decomposition of the test material was accomplished by heating the sample in a Lindbergh Box Furnace (Model 51894-S-Pit) with inside dimensions of 229×241×357 mm and a volume of 19.7 liters. The weighed test specimens were heated, starting at a temperature no greater than 70° C., at a rate of 20(±2)° C./minute. Continuous weight loss was monitored by a load cell connected to the sample specimen platform. The thermal decomposition products were transferred to the animal exposure chamber by a glass tube approximately 0.80 m in length having an inside diameter of 19 mm. The furnace chamber was aspirated at a rate of 11 L/minute, and the furnace effluent was cooled and diluted by an additional 9 L/minute of cooled medical grade breathing air, resulting in a total flow of 20 L/minute through the animal chamber. The diluent air is run through coiled copper tubing (0.25 in. O.D.) immersed in an icebath filled with ice and tap water. Prior to each test run, the accuracy of the flow meters was checked with a primary standard gas flow meter (Mini-Buck Calibrator™, Model M-30) by connecting it to the inlet of the Pyrex glass tube leading to the animal exposure chamber. Values are obtained with and without the dilution air flowing into the test chamber. During each test, both flowmeters were continuously monitored visually and readjusted to their pre-test setting as necessary.

Male Swiss Webster mice, weighing from 22 to 30 g on the day of exposure, were used in these experiments. No formal randomization procedure was utilized in the selection of animals for each test group; animals were selected on the basis of apropriate body weight and obvious signs of good health.

Test animals 5 to 7 weeks old were ordered from a registered U.S.D.A. supplier (Hilltop Laboratories, Scottdale, Pa.). Upon receipt, the animals were individually identified by number and housed not more than eight to a cage. Animals were identified on their cages by group number and individual assigned number. Color coded indelible ink markings on the fur on the back of the animals were used for identification purposes. The cages were of the polycarbonate "shoe-box" type, 18-in. long, 9–5-in. wide and 5-in. deep with commercial corncob bedding used as litter.

Prior to testing, the animals were placed in a separate quarantine room for a minimum of one week. The quarantine room conditions were maintained at temperatures between 18 and 26° C. and 40 to 70% relative humidity. Those animals that were unsuitable by reason of size health or other criteria were discarded. Animals were allowed free access to water and standard formula Purina Laboratory Rodent Chow. The test animals were housed and cared for following standard procedures. Facilities for housing and care of animals are accredited under the rules and regulations of the American Association for Laboratory Animal Sciences and are licensed by the U.S.D.A. according to Public Law 91-579 (Animal Welfare Act of 1970).

The weighed test specimen was placed in the quartz crucible resting on the pedestal within the furnace. The starting point for exposure of animals was established during an initial experiment with 10 g of the test material by recording the temperature at which 1% of the sample weight was consumed ($T_1$ %). This temperature was used in ensuing runs as the temperature at which animal exposures were initiated. Animal exposures were conducted for 30 minutes from the point of $T_1$%. If all animals expired prior to 30 minutes, the test was terminated when the recorded CO levels returned to baseline. Prior to the initiation of an animal exposure experiment, the animals were positioned with their heads protruding through latex dams (reinforced with duct tape) into the exposure chamber. Rubber stoppers sealed the open end of the animal ports and assisted in preventing the mice from backing out of the neck restraint. At the same time, a continuous flow of room air was maintained at a rate of 20 L/minute through the animal chamber. After the animals were allowed a brief acclimation period, the experiment was initiated by starting the furnace controller and activating the data logging system. At $T_1$%, the exposure chamber was quickly connected to the furnace and the 30-minute exposure run initiated. Exposure chamber and furnace temperatures were monitored by thermocouple throughout the test period. All glassware was cleaned and dried between each test run. As necessary, stubborn residues in the quartz tube were treated with commercial oven cleaner and burned off with a torch. Ammonia-based cleanser, soap and water and ethanol were employed in the cleaning of the chamber and connecting glassware.

A sufficient number of experiments were conducted with varying amounts of sample weight to enable the development of the concentration-response relationship and the derivation of the $LC_{50}$ and 95% confidence limits by the moving averages method of Weil (4). Each experiment was followed by a 10-minute recovery period, during which time the animals were observed for lethality and examined for the presence of eye damage (corneal opacity). As required by the referenced test method, the eye condition was scored as "no apparent damage", "some apparent damage" or "some severe damage".

Analysis for $O_2$, CO and $CO_2$ was made continuously at a sampling rate of 0.5 to 1.0 L/min. with the following instrumentation: Beckman OM-11 Analyzer ($O_2$); Beckman 865 Infrared Analyzers (CO and $CO_2$). Routine calibration of the CO and $CO_2$ analyzers was performed prior to each day's testing. Calibration gases (1.0% CO, 10.0% $CO_2$ certified by Scientific Gas Products, Inc.) were metered into the analyzers in the same way that unknown samples were introduced. The $O_2$ analyzer was calirated with room air. Calibration of the analyzers was established to within 1% of full scale.

A summary of the test results presented in a manner consistent with the New York State Article 15 filing format is provided in Table VII, and a tabular summary of the individual test runs is included in Table VIII.

The $LC_{50}$ value (95% confidence limits) for the test material was determined to be 29.6 (25.3–34.6) grams from a series of combustion experiments ranging from 20.4 to 50 grams.

Guidelines on file with the New York City MEA provide the comparison of covered products to wood on the basis of a "passing value" ($LC_{50}$) of 19.7 grams. For wallcovering materials of a thickness less than 1.0 mm, a value (based on surface area) of 31,392 $mm^2$ may be used.

When tested under the controlled laboratory conditions specified in this report, the $LC_{50}$ value for the test article was determined to be 29.6 grams. The surface area corresponding to the $LC_{50}$ value ($LA_{50}$) was 68,173 $mm^2$. Based on these test results, this test material successfully satisfied the requirements of Section 27.348 of the Building Code of the City of New York.

TABLE VII

| PERFORMANCE PARAMETER | TEST SAMPLE |
|---|---|
| $LC_{50}$ (grams) | 29.6 |
| 95% Confidence Limits (g) | 25.3–34.6 |
| $LA_{50}$ ($mm^2$) | 68.173 |
| Mean Percent Sample Residue (%) | 80.72 |
| Furnace Temperature at 1% Weight Loss (°C.)* | 299 |
| Temperature Range at Major Decomposition (°C.)** | 342–395 |
| Mean Temperature at Ignition (°C.) | 312 |
| Peak CO (ppm)** | 10,682 |
| Temperature at Peak CO (°C.) | 392 |
| Peak $CO_2$ (%)** | 1.50 |
| Temperature at Peak $CO_2$ (°C.) | 438 |
| Minimum $O_2$ (%)** | 19.0 |
| Temperature at Minimum $O_2$ (°C.) | 398 |
| Number of Times the Exposure Chamber Temperature Exceeded 45° C. | 0 |
| Average Duration of Temperature Excursion (sec) | — |
| Eye Condition of Test Animals*** | B |
| Number of Tests Conducted | 5 |

*From test conducted at 10.0 grams.
**From test conducted within 5 percent of $LC_{50}$ value (representative $LC_{50}$ test)
***Eye condition characterized as:
(A) all apparently normal;
(B) some apparent damage;
(C) some severe damage (from representative $LC_{50}$ test).

TABLE VII

| | 042-KW-5 | 042-KW-2 | 042-KW-3 | 042-KW-4 | 042-KW-5 |
|---|---|---|---|---|---|
| Sample Weight (g) | 20.4 | 25.5 | 31.9 | 39.9 | 50.0 |
| Percent Weight Loss | 18.2 | 18.7 | 20.1 | 20.1 | 19.3 |
| Flaming Temp. (°C.) | 315 | 307 | 312 | 311 | 335 |
| Temp. Range at Most Rapid Weight Loss (°C.) | 326–376 | 335–385 | 342–395 | 338–393 | 326–376 |
| Number Responding/Number Exposed | 1/4 | 0/4 | 3/4 | 4/4 | 4/4 |
| Percent Response | 25 | 0 | 75 | 100 | 100 |
| Maximum CO (ppm) | 8035 | 9008 | 10682 | 10269 | 8035 |
| Total CO (Ct) (ppm) | 23991 | 28981 | 39116 | 46316 | 23991 |
| Temperature at $CO_2$ Maximum (°C.) | 376 | 386 | 392 | 388 | 376 |
| Maximum $CO_2$ concentration (%) | 1.0 | 1.1 | 1.5 | 1.9 | 1.0 |
| Total $CO_2$ (Ct) (percent-min) | 5.61 | 7.60 | 9.91 | 11.96 | 5.61 |
| Temperature at $CO_2$ Maximum (°C.) | 451 | 461 | 438 | 446 | 451 |
| Minimum $O_2$ (%) | 19.8 | 19.3 | 19.0 | 19.1 | 19.8 |
| Temperature at $O_2$ Minimum (°C.) | 381 | 391 | 398 | 396 | 381 |
| Eye Condition* | B | B | B | — | — |

*Eye Condition of Surviving Animals:
(a) All apparently normal;
(b) some apparent damage;
(c) some severe damage.
Mean Furnace Temp at
Spontaneous Flame: 312° C.
Residue (Sample Avg.): 80.72%

EXAMPLE 6

A 100-percent Jewel Yarn/DE-37 LEX Textured Glass Yarn wallcovering made according to Example 1 was evaluated under the 1991 Edition of UBC Standard 42-2 "Standard Test Method for Evaluating Room Fire Growth Contribution of Textile Wallcovering". Based on the results obtained, the wallcovering material made according to Example 1 meet the required acceptance criteria, when tested adhered to 0.5-in. thick primed Type X gypsum wallboard with Heavy Duty Clear #00233 adhesive and allowed to cure for at least 14 days prior to testing.

For the fully-lined protocol, the specimens were mounted in the Fire Test Room on all walls, except the doorway wall as specified by the test protocol.

The specimens were conditioned in an atmosphere maintained between 68 and 78° F. (20° and 26° C.) temperature and 45- to 55-percent relative humidity.

The fully-lined protocol described in the UBC Standard 42-2 was used. The test facility was calibrated prior to the test. An initial volumetric flow rate of 1,000 scfm was established through the duct and was increased to a maximum flow rate of 7,000 scfm when the oxygen level drops below 14 percent. All sampling and recording devices were turned on and steady-state baseline readings established for approximately 3 minutes. The burner was ignited and the gas flow rate increased to provide a rate of heat release of 40 kW. The exposure at the 40 kW level was continued for 5 minutes. Immediately following the 5-minute exposure, the gas flow rate was increased to provide a rate of heat release by the burner of 150-kW exposure for 10 minutes. Video and voice recordings were used to document the growth of the fire. The gas flow to the burner was turned off 15 minutes after ignition. Damage after the test was documented by photo/video media and a written assessment of the damage was produced.

Four walls at tight angles formed the test room. The interior dimensions of the test room, with the specimens in place, measured 8×12 ft. The ceiling was 8 ft above the floor. There was a 30×80 in. doorway in the center of one of the 8×8 ft. walls. The inside surface of the wall with the doorway was constructed using nominal ½-in. Calcium silicate board having a density of 46 pcf. The test room was framed using 2×4-in. studs on 16-in. centers. The interior surfaces (floor, ceiling, and walls) of the test room were covered with gypsum wallboard.

A hood was located immediately adjacent to the door of the test room. The bottom of the hood was level with the top surface of the room. The face dimensions of the hood were 8×8 ft. with a depth of 3½ ft. The hood was topped by a plenum having a 3×3 ft. cross section 3 ft. high. The plenum was connected to a horizontal exhaust duct having an internal diameter of 23 in. The hood was capable of moving up to 7,000 cfm. A variable speed blower permitted control of exhaust volumes.

The temperature of the fire test building was maintained above 40° F. and the relative humidity was less than 75 percent, throughout the test.

Two total heat flux gauges were mounted 2 in. above the floor surface facing upward in the geometric center of the room. Gardon type gauges with a flat black surface and 180 view angle were used. While in operation, they were maintained at a constant temperature above the dew point by a heated water supply.

Bare type K thermocouples, 0.020 in. diameter, were used at each required location. A thermocouple was located in the interior plane of the door opening on the door centerline 4 in. down from the header. Thermocouples were also located 4 in. below the ceiling at the center of the room and the center of each of the four ceiling quadrants. The average of these five thermocouples was used to determine the upper level air temperature. A thermocouple was also located directly over the center of the burner. The thermocouples penetrated through the ceiling with their junctions 4 in. away from the surface. Spackling compound was used to fill the holes around the thermocouple wires. One pair of thermocouples was placed 11 ft downstream of the entrance to the duct. The pair of thermocouples straddled the center of the duct and were separated 2 in. from each other.

A bi-directional probe was used to measure gas velocity in the duct. The probe consisted of a short stainless steel cylinder 1¾ in. long and ⅞ in. inside diameter with a solid diaphragm in the center. The pressure taps on either side of the diaphragm supported the probe. The axis of the probe was along the centerline of the duct 11 ft downstream from the entrance. The taps were connected to a pressure transducer capable of resolving pressure differences of 0.001 in. water.

The ignition source was a gas burner with a nominal 12×12-in. top surface. The burner consisted of a metal box 12-in. tall containing a 5-in. layer of Ottawa sand used to provide the horizontal surface through which the gas was supplied. The burner box was located such that the edge of the diffusion surface was located 2 in. from both walls in the left corner of the room opposite the door. The gas supply to the burner was C.P. grade propane. The flow rate was metered using rotameters, a mass flow meter, and continuous weight loss. The burner system was designed to allow switching from 40 kW to 150 kW within 5 seconds. The burner was ignited using a remotely controlled spark igniter.

Wallcoverings may be judged to perform satisfactorily when tested according to the fully-lined test procedure and meeting the following criteria:

1) Flames shall not spread to the ceiling during the 40-kW exposure.

2) During the 150-kW exposure:

a) Flames shall not spread to the outer extremity of the sample on the 8×12-ft. walls.

b) Flashover shall not occur. Flashover shall be judged to have occurred when heat flux at floor level exceeds 20 kW/m$^2$, average upper-level air temperatures exceed 1,100° F., or flames project out the door opening.

The findings were as follows:

1) The flames did not reach the ceiling during the 40 kW exposure.

2) During the 150-kW exposure:

Flames did not spread to the outer extremity of the sample on the 8×12 ft. walls. Flashover did not occur. The flames did not project out the doorway. The maximum heat flux reading at floor level was 1.9 kW/m$^2$ at 13 minutes 12 seconds. The maximum upper-level air temperature was 519° F., at 6 minutes 30 seconds.

Based on the findings listed above, the sample wallcovering according to Example 1 meet the acceptance criteria as specified for the fully-lined test protocol in the UBC Standard 42-2, when tested adhered to primed 0.5-in. thick Type X gypsum wallboard with Heavy Duty Clear #00233 adhesive, and allowed to cure for at least 14 days prior to testing.

EXAMPLE 7

A fabric for use as a wallcovering was prepared as follows:

A glass fiber DE 37 1/0 single end yarn resin pigment dyed 560 gray/blue, single ply, was tight woven in a dobby weave using a Dornier 180-210 CM GTV 650 heavy duty loom. Leno selvage was made using DE 900 1/0 (left/white) (right/red). The weave specification was the same as described above with respect to Example 1. The glass fiber fabric was then coated with a face coating consisting of a Teflon® fluorochemical emulsion made by duPont/Ciba Geigy. A wet pickup of 30%, using 40–60 gallons per liter was used. The formulation of the Teflon® is believed to be the same as the formulation shown in Table 2 for FC-247. The fabric having the face coating layer was then cured at a drying temperature of 200° F. A back coating was then applied using an acrylic resin having the characteristics and properties listed in Table IV. The glass transition temperature was Tg–10±5. The weight of the acrylic resin backing applied to the glass fabric layer was 2.25 ounces backing per square yard. The unit weight of the fabric was 13.1 oz/yd$^2$ (442 g/m$^2$). The thickness of the fabric was 0.03 in.±0.005 in. (0.86 mm).

EXAMPLE 8

A glass yarn fabric for acoustic wall paneling and ceiling tiles was made using a DE 37 1/0 single end textured glass yarn, pigment resin dyed 560 gray/blue, single ply. Leno selvage was made using DE 900 1/0 (left/white) (right/red). The resin pigment dyed yarn was tight woven in a dobby weave using a Dornier 180-210 CM GTV 650 heavy duty loom. The weave specification was the same as described above with respect to Example 1. A face coating of Teflon® fluorochemical emulsion. A wet pickup of 30% using 40 to 60 gallons per liter was used. The face coating fabric was cured at a temperature of 200° F. A back coating was then applied using an acrylic resin having the characteristics and properties shown in Table IV. The glass transition temperature used was Tg–10±5. The weight of the acrylic resin backing was 1.25 ounces backing per square yard. The weight of the fabric was 16.0±0.5 ounces per linear yard. The thickness of the fabric was 0.181±0.005 inches.

EXAMPLE 9

It is believed that if the tests described in Examples 3 and 4 were performed on a fabric prepared according to Example 7, the same or substantially similar results would be achieved.

EXAMPLE 10

It is believed that if the tests described in Examples 3 and 4 were performed on a fabric prepared according to Example 8, the same or substantially similar results would be achieved.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology of terminology employed herein is for the purpose of description and not of limitation.

What is claimed is:

1. A method of making a glass yarn fabric for wallcoverings, acoustical wall panels and acoustical ceiling tiles comprising the steps of:

weaving a pigment dyed glass fiber yarn to form a glass yarn layer;

applying a stain resistant polymeric fluorocarbon face coating to a first surface of said glass yarn layer; and applying an opaque back coating layer comprising an acrylic resin to a second surface of said glass yarn layer, wherein said steps form a flame retardant fabric having a flame time of two seconds or less and a char length of less than 5.5 inches.

2. The method according to claim 1, wherein said stain resistant polymeric fluorocarbon is selected from the group consisting of tetrafluoroethylene, fluorinated ethylene-propylene hexafluoropropylene and a fluorosurfactant wetting agent.

3. The method according to claim 1, wherein titanium dioxide is added to said acrylic resin to form said back coating layer.

4. The method according to claim 1, wherein said pigment dyed glass fiber yarn is selected from the group consisting of DE 37 1/0 single end, DE 75 1/0 single end, and DE 150 1/0 single end textured glass yarns.

5. The method according to claim 1, wherein said acrylic resin is made from ethyl acrylate and methyl methacrylate.

6. The method according to claim 1, further comprising the step of curing the glass yarn layer at a temperature of about 200 ° F. after the step of applying the face coating.

7. The method according to claim 1, further comprising the step of curing the glass yarn layer at a temperature of about 250 ° F. after the step of applying the back coating.

* * * * *